US011380532B2

(12) United States Patent
Yamaguchi

(10) Patent No.: US 11,380,532 B2
(45) Date of Patent: Jul. 5, 2022

(54) METHOD FOR IMAGING MASS SPECTROMETRY AND IMAGING MASS SPECTROMETER

(71) Applicant: SHIMADZU CORPORATION, Kyoto (JP)

(72) Inventor: Shinichi Yamaguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/216,838

(22) Filed: Mar. 30, 2021

(65) Prior Publication Data

US 2021/0398787 A1 Dec. 23, 2021

(30) Foreign Application Priority Data

Jun. 17, 2020 (JP) ..... JP2020-104228

(51) Int. Cl.
*H01J 49/00* (2006.01)

(52) U.S. Cl.
CPC ..... *H01J 49/0036* (2013.01)

(58) Field of Classification Search
CPC ..... H01J 49/0036; H01J 49/0004
USPC ..... 250/281, 282
See application file for complete search history.

(56) References Cited

U.S. PATENT DOCUMENTS

2013/0080072 A1* 3/2013 Ikegami ..... H01J 49/0004 702/23
2018/0197726 A1* 7/2018 Yamaguchi ..... G06T 7/97

FOREIGN PATENT DOCUMENTS

JP 2013-068565 A 4/2013
WO 2015/053039 A1 4/2015

OTHER PUBLICATIONS

"Mass Spectrometry Imaging Data Analysis Software IMAGEREVEAL MS Ver.1 1", a product catalogue by Shimadzu Corporation, first edition published in Jan. 2020, 16 pages.

(Continued)

*Primary Examiner* — Michael Maskell
(74) *Attorney, Agent, or Firm* — Sughrue Mion, PLLC

(57) ABSTRACT

In an imaging mass spectrometer for analyzing the same kind of samples using results of imaging mass spectrometric analysis performed on those samples, a measurement section (1) acquires mass spectrometric data by performing an analysis on each of the micro areas on a sample. A region-of-interest setter (32) sets an ROI on each sample, and divides each ROI into the same number of subregions each including the micro areas so that the subregions correspond to each other on the samples respectively covering roughly identical sites on the samples. An individual-index-value calculator (33) calculates an individual index value for each subregion, using mass spectrometric data acquired at the micro areas in the subregion, the individual index value reflecting a similarity or difference among the samples in terms of a degree of expression of each m/z value. A general-index-value calculator (34) calculates a general index value for each m/z value among the ROIs of the samples, using the individual index values calculated for the ink values for each subregion included in each ROI.

8 Claims, 5 Drawing Sheets

(56) References Cited

OTHER PUBLICATIONS

"Image Classification", https://www.an.shimadzu.co.jp/sites/an.shimadzu.co.jp/files/ckeditor/bio/imagereveal/faq/3-2-3.pdf, 48 pages, obtained Mar. 22, 2021.
"Similar Image Extraction", https://www.an.shimadzu.co.jp/sites/an.shimadzu.co.jp/files/ckeditor/bio/imagereveal/faq/3-2-1.pdf, 67 pages, obtained Mar. 22, 2021.

* cited by examiner

METHOD FOR IMAGING MASS SPECTROMETRY AND IMAGING MASS SPECTROMETER

TECHNICAL FIELD

The present invention relates to a method for imaging mass spectrometry and an imaging mass spectrometer.

BACKGROUND ART

An imaging mass spectrometer disclosed in Patent Literature 1 or other related documents includes an ion source employing a matrix-assisted laser desorption/ionization method. This type of mass spectrometer allows a user to observe the morphology of the surface of a section of biological tissue or similar type of sample through an optical microscope, and collects mass spectrum data over a predetermined range of mass-to-charge ratios (strictly speaking, this should be called "m/z", although the term "mass-to-charge ratio" is used in this description according to common practices) for each of the micro areas which are set within a desired two-dimensional area on the sample. In another commonly known method for imaging mass spectrometry, as disclosed in Patent Literature 2 or other related documents, a sample collection method called "laser microdissection" is used to cut out a piece of sample from each of the micro areas which are set within a desired two-dimensional area on a target sample. A liquid sample is prepared from each piece of the target sample and supplied to a mass spectrometer to obtain mass spectrum data for each micro area.

Any of those methods includes the steps of extracting, for example, the signal-intensity value at the mass-to-charge ratio of an ion originating from a specific compound from mass spectrum data acquired for each micro area on a sample (this type of data may hereinafter be called "MS imaging data"), and creating an image in which the extracted signal-intensity values are arranged at the corresponding micro areas on the sample, to obtain an image showing the state of distribution of the specific compound (this type of image is hereinafter called "MS imaging graphic").

Those who conduct an analysis using imaging mass spectrometry often desire to investigate a difference or similarity in the distribution of a compound among a plurality of samples (typically, between two samples). For example, in a study concerning an effect which a drug administered to a living organism, such as a mouse, may have on an internal organ of that living organism, it is necessary to perform an imaging mass spectrometric analysis on each of the sample sections respectively collected from roughly identical sites of two individual mice one of which has the drug administered and the other not, and to analyze the difference between the two sets of MS imaging data acquired by the analyses. For such an analysis, for example, the "differential analysis" function provided in the mass spectrometry imaging data analysis software disclosed in Non Patent Literature 1 can be used.

CITATION LIST

Patent Literature

Patent Literature 1: JP 2013-68565 A
Patent Literature 2: WO 2015/053039 A

Non Patent Literature

Non Patent Literature 1: "Mass Spectrometry Imaging Data Analysis Software IMAGEREVEAL MS Ver.1.1", a product catalogue by Shimadzu Corporation, first edition published in January 2020

SUMMARY OF INVENTION

Technical Problem

Typically, in a differential analysis based on MS imaging data acquired for two sections of samples, an individual in charge of the analysis (user) specifies a region of interest (ROI) which excludes, for example, the sites that are neither necessary for the analysis nor draw a user's interest in the section of the sample, and a differential analysis, such as a test, is performed on the two sets of MS imaging data acquired for the ROIs. However, for example, if only a small number of compounds have a significant difference in distribution in the samples while a considerable number of compounds have insignificant differences in distribution, the results of the latter group of compounds having insignificant differences may obscure the differences of the former group of compounds, making it impossible to perform an accurate differential analysis.

The present invention has been developed to solve the previously described problem. Its objective is to provide a method for imaging mass spectrometry and an imaging mass spectrometer by which a compound that exhibits a difference can be efficiently and correctly located when a plurality of sets of MS imaging data respectively acquired for a plurality of samples are compared with each other.

Solution to Problem

One mode of the method for imaging mass spectrometry according to the present invention developed for solving the previously described problem is a method for imaging mass spectrometry in which a plurality of samples of the same kind are analyzed using mass spectrometric data acquired by performing an imaging mass spectrometric analysis on each of a plurality of micro areas which are set on each of the plurality of samples, the method including:

a region-of-interest setting step configured to set a region of interest on each of the plurality of samples to be analyzed, and to divide each of the regions of interest into the same number of subregions each including a plurality of micro areas so that the subregions correspond to each other on the plurality of samples respectively covering roughly identical sites on the samples;

an individual-index-value calculation step configured to calculate an individual index value for each of the subregions, using mass spectrometric data acquired at micro areas included in the subregion, the individual index value reflecting the similarity or difference among the plurality of samples in terms of a degree of expression of each mass-to-charge-ratio value; and a general-index-value calculation step configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

One mode of the imaging mass spectrometer according to the present invention developed for solving the previously described problem is an imaging mass spectrometer in which a plurality of samples of the same kind are analyzed using results acquired by performing an imaging mass spectrometric analysis on each of the plurality of samples, the imaging mass spectrometer including:

a measurement section configured to acquire mass spectrometric data by performing an imaging mass spectrometric analysis on each of a plurality of micro areas which are set on a sample;

a region-of-interest setter configured to set a region of interest on each of the plurality of samples to be analyzed, and to divide each of the regions of interest into the same number of subregions each including a plurality of micro areas so that the subregions correspond to each other on the plurality of samples respectively covering roughly identical sites on the samples;

an individual-index-value calculator configured to calculate an individual index value for each of the subregions, using mass spectrometric data acquired by the measurement section at the micro areas included in the subregion, the individual index value reflecting the similarity or difference among the plurality of samples in terms of a degree of expression of each mass-to-charge-ratio value; and a general-index-value calculator configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

Advantageous Effects of Invention

In the previously described modes of the method for mass spectrometry and the imagine mass spectrometer according to the present invention, the "plurality of samples of the same kind" are, for example, a plurality of sample sections all of which include the same kind of biological tissue in the case where the samples are sections of biological tissues. In other words, the plurality of samples are such types of samples that are commonly subjected to differential or comparative analyses.

The phrase "so that the subregions correspond to each other on the plurality of samples respectively covering roughly identical sites on the samples" means, for example, that the subregions corresponding to each other on different samples should include the same kind of biological tissue in the case where a plurality of kinds of biological tissues (e.g., internal organs) are included in each sample.

In the previously described modes of the method for mass spectrometry and the imaging mass spectrometer according to the present invention, each region of interest is divided into a plurality of subregions having a relatively small area, and the individual index value is calculated for each subregion rather than the entire region of interest. Therefore, information concerning a compound which exhibits a difference in distribution within a small region on the samples can be accurately obtained. This enables efficient and accurate detection of a compound exhibiting a difference in distribution or intensity among a plurality of samples.

DESCRIPTION OF EMBODIMENTS

An imaging mass spectrometer as one embodiment of the present invention is hereinafter described with reference to the attached drawings.

System Configuration in Present Embodiment

Figure 1:
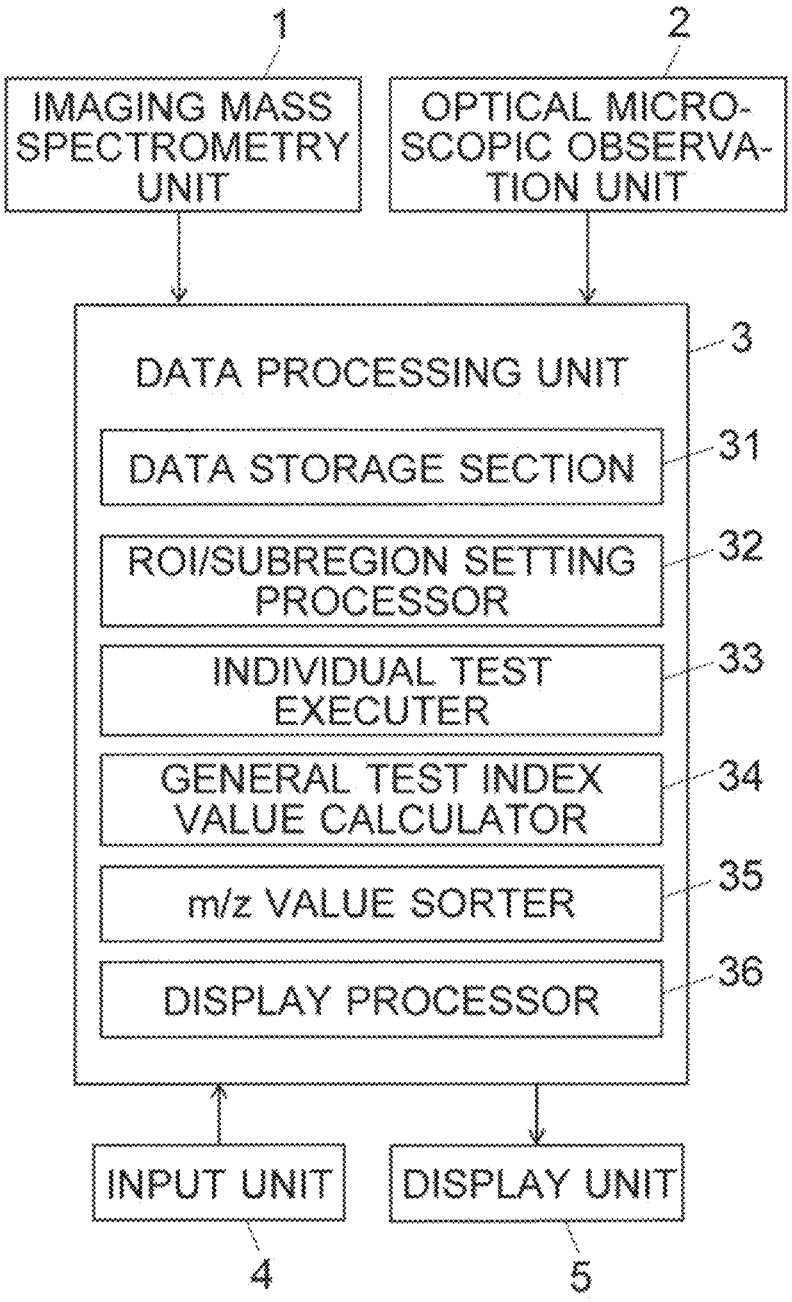
FIG. 1 is a schematic block configuration diagram of an imaging mass spectrometer as one embodiment of the present invention.

FIG. 1 is a schematic block configuration diagram of the imaging mass spectrometer according to the present embodiment.

As shown in FIG. 1, the imaging mass spectrometer according to the present embodiment includes an imaging mass spectrometry unit 1, optical microscopic observation unit 2, data processing unit 3, input unit 4, and display unit 5.

The imaging mass spectrometry unit 1 is, for example, a system using an atmospheric pressure MALDI ion trap time-of-flight mass spectrometer as disclosed in Patent Literature 1. A system disclosed in Patent Literature 2 may also be used, which is a combination of a laser microdissection device and a mass spectrometer configured to perform a mass spectrometric analysis on a sample prepared from a micro-sized sample piece collected from a target sample by the laser microdissection device. The optical microscopic observation unit 2 is a microscope capable of acquiring an optical microscopic image of a sample, such as a section of biological tissue. In the system as disclosed in Patent Literature 1, the optical microscopic observation unit 2 is normally integrated with the imaging mass spectrometry unit 1.

The data processing unit 3 includes, as its functional blocks, a data storage section 31, ROI/subregion setting processor 32, individual test executer 33, general test index value calculator 34, m/z value sorter 35, and display processor 36.

In the system according to the present embodiment, the data processing unit 3 normally includes a personal computer or more sophisticated workstation as its main component, on which the aforementioned functional blocks can be embodied by running, on the computer, dedicated data-processing software installed on the same computer. In that case, the input unit 4 includes a keyboard and pointing device (e.g., mouse) provided for the computer, while the display unit 5 includes a display monitor.

Analytical Processing in System According to Present Embodiment

Figure 2:
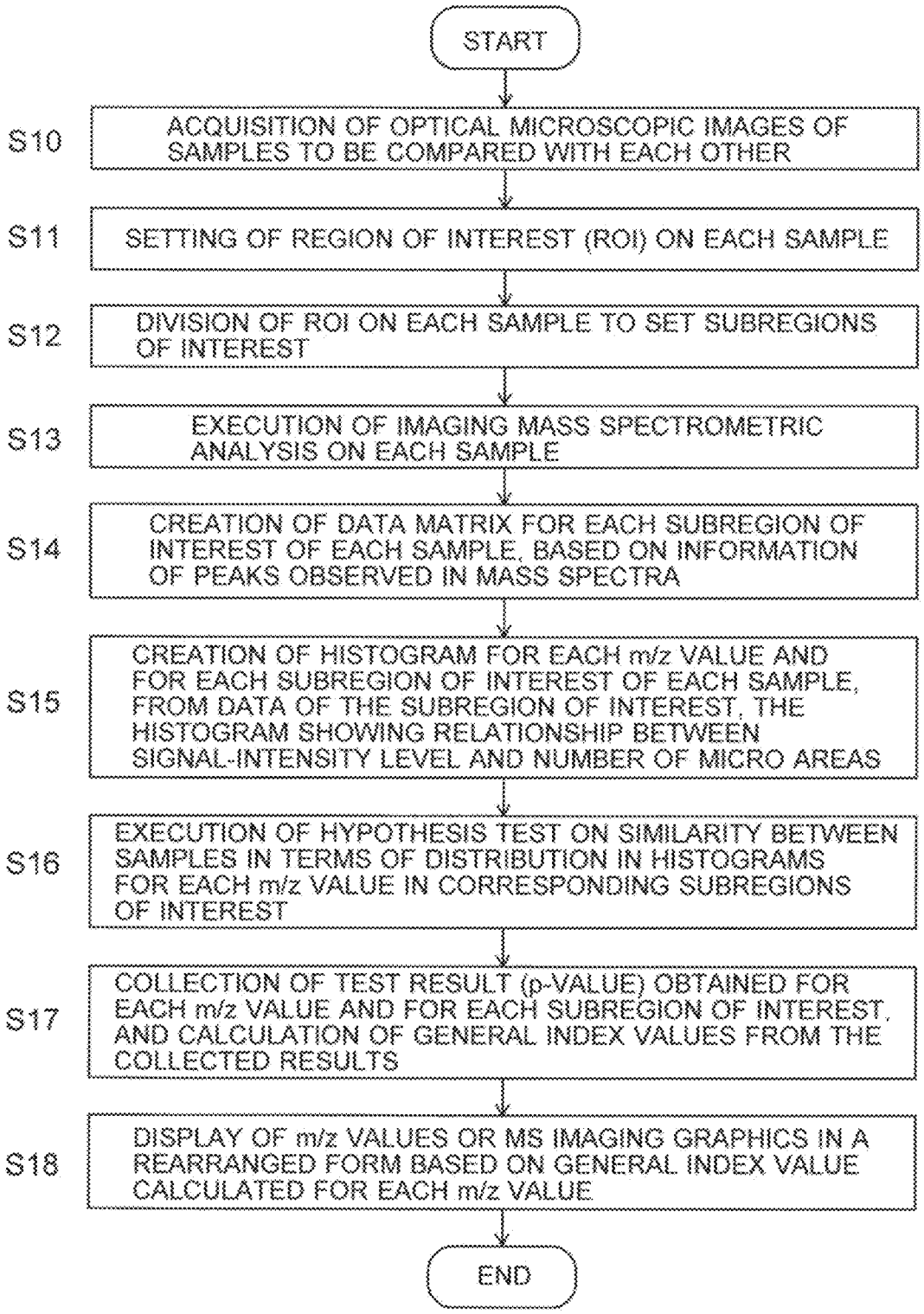
FIG. 2 is a flowchart showing one example of the procedure of the analytical processing in the imaging mass spectrometer according to the present embodiment.
Figure 4A:
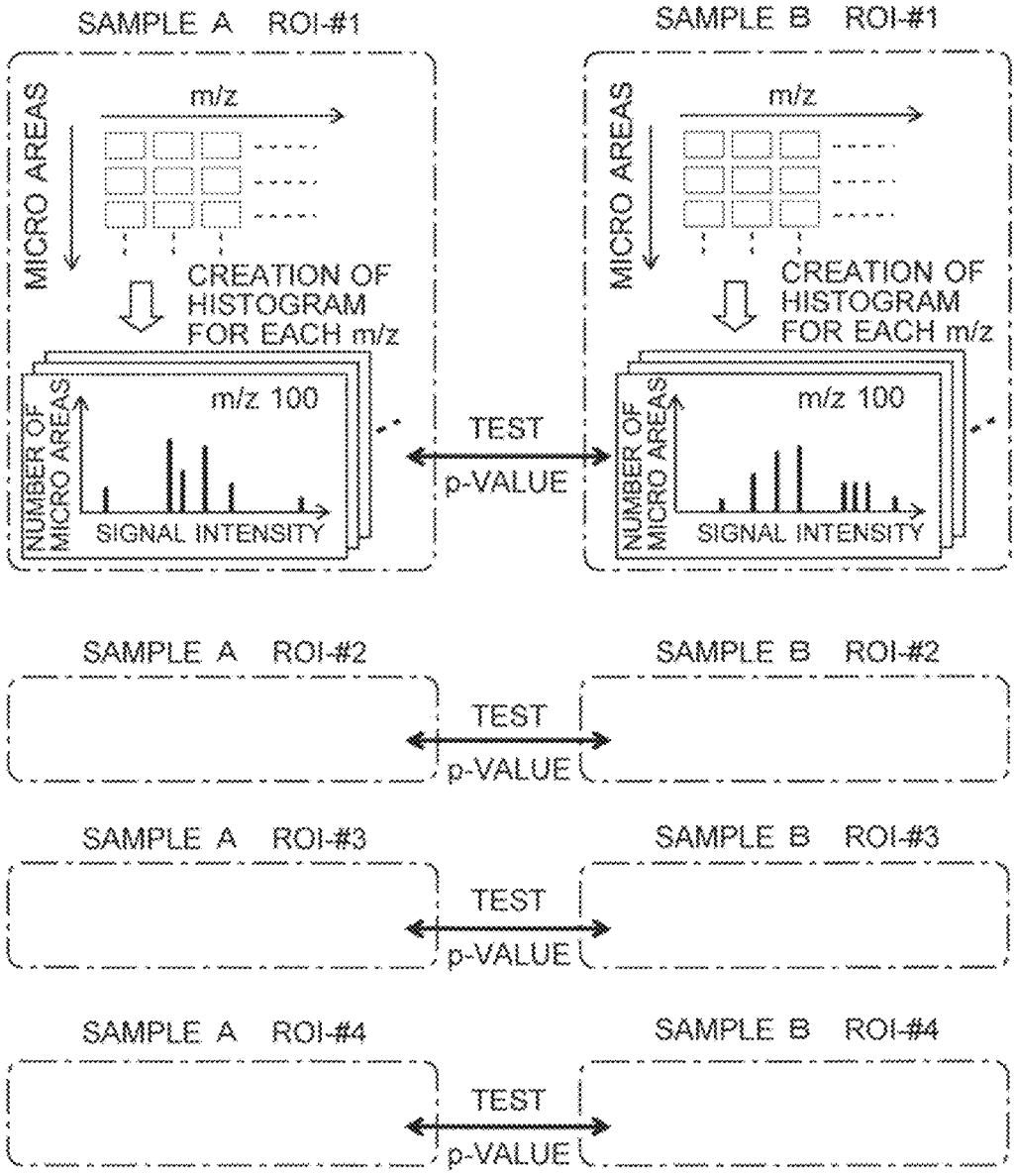
FIGS. 4A and 4B are model diagrams for explaining the analytical processing in the imaging mass spectrometer according to the present embodiment.
Figure 4B:
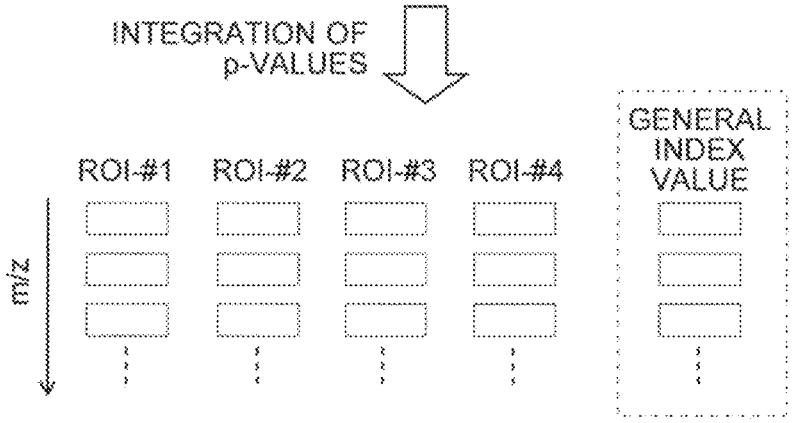

A procedure of the analytical processing for a differential analysis on two samples using the imaging mass spectrometer according to the present embodiment is hereinafter described with reference to FIGS. 2, 4A and 4B. FIG. 2 is a flowchart showing one example of the procedure of the analytical processing. FIGS. 4A and 4B are model diagrams for explaining the analytical processing. Each sample is a thin slice of biological tissue collected from the brain, an internal organ or other parts of a laboratory animal. The following description specifically deals with an illustrative example in which a differential analysis is performed for a sample section collected from the chest area of a mouse to which a drug was administered (this sample is hereinafter called the "drug-administered sample") and one collected from the chest area of a mouse with no drug administered (this sample is hereinafter called the "control sample").

The two samples are individually placed on two sample plates and set at a predetermined position in the optical microscopic observation unit 2. The optical microscopic observation unit 2 takes an optical microscopic image of each sample. The acquired image data are stored in the data storage section 31 (Step S10).

When a predetermined operation is performed by a user with the input unit 4, the ROI/subregion setting processor 32 displays the optical microscopic image of each sample on the display unit 5. The user views the optical microscopic image of each sample on the screen, and performs an operation for setting, for each sample, an ROI to be subjected to the differential analysis. Upon this operation, the ROI/subregion setting processor 32 sets an ROI on each sample (Step S11).

Figure 3A:
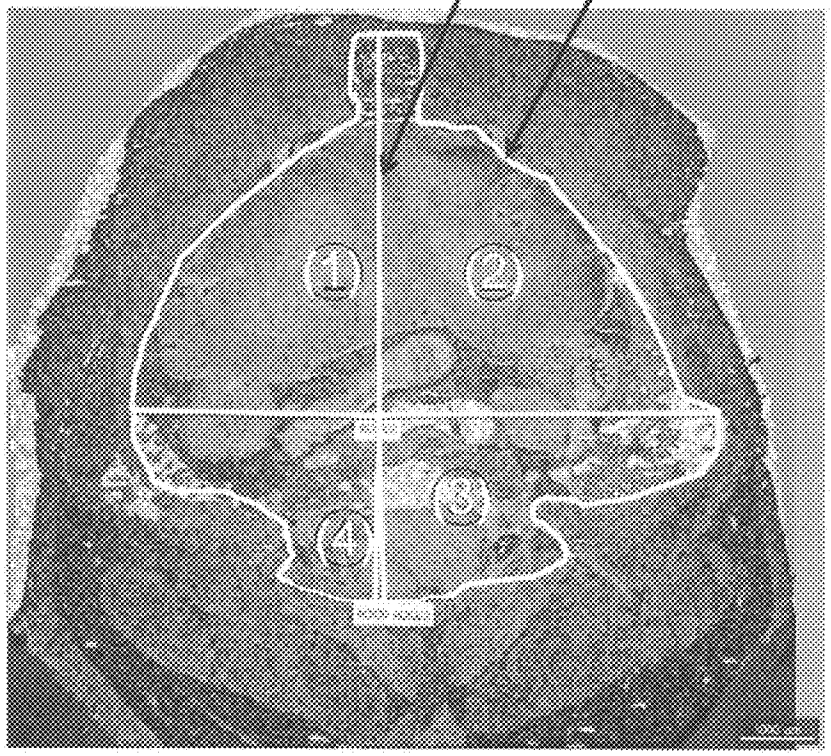
FIGS. 3A and 3B are images showing one example of the setting of the region of interest and the subregions of interest in the imaging mass spectrometer according to the present embodiment.
Figure 3B:
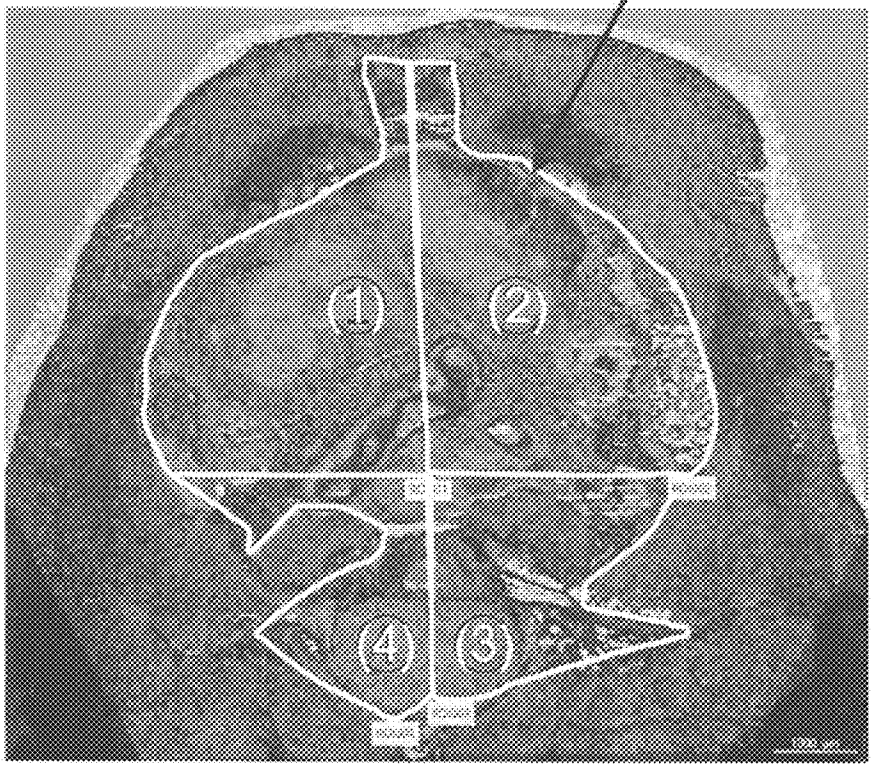

FIG. 3A is an optical microscopic image of the control sample, and FIG. 3B is that of the drug-administered sample. In the present example, it is the portion of an internal organ that is of interest for the user; the skin and muscles surrounding that portion are of no interest. Accordingly, the user specifies, as the ROI, an area which roughly includes the portion of the internal organ on the optical microscopic image of each sample. The user can specify the ROI by drawing a line surrounding the desired area on the image, using a pointing device included in the input unit 4. The outer curves in FIGS. 3A and 3B are the lines specifying the ROIs. As can be understood from FIGS. 3A and 3B, the two samples which originate from different individual mice are yet roughly identical in terms of the entire shape of the sample as well as the arrangement of the internal organ, since those samples are sections of roughly the same site of the same kind of mice. Accordingly, in normal cases, it is possible to set appropriate ROIs that should be compared on the two samples.

Next, the user performs an operation for dividing the ROI of each sample into subregions so that roughly identical sites will be respectively included in those subregions on both samples. Upon this operation, the ROI/subregion setting processor 32 divides the ROI on each sample into a plurality of subregions of interest (Step S12). Additionally, the ROI/subregion setting processor 32 assigns serial numbers to the subregions of interest within each ROI so as to establish correspondence between the subregions of interest which include roughly identical sites on the samples. In the example of FIGS. 3A and 3B, each ROI is divided into tour subregions of interest, to which numbers (1) through (4) are assigned. The division of an ROI may be made at any position. The number of divisions as well as the area of each subregion of interest may also be arbitrarily determined.

Subsequently, the user temporarily removes the samples from the optical microscopic observation unit 2, applies a matrix for MALDI on the surface of each sample, and sets the samples at a predetermined position in the imaging mass spectrometry unit 1. The imaging mass spectrometry unit 1 performs a mass spectrometric analysis and acquires mass spectrum data over a predetermined mass-to-charge-ratio range for each micro area formed by dividing the area within the ROI in a fine grid-like form on each of the set samples (Step S13). In place of the normal type of mass spectrometric analysis, an MS/MS analysis or $MS^n$ analysis (where n is equal to or greater than three) may be performed in which an ion having a specific mass-to-charge ratio or falling within a specific mass-to-charge-ratio range is selected as a precursor ion to acquire product-ion spectrum data.

Specifically, the imaging mass spectrometry unit 1 irradiates one micro area with a laser beam for a short period of time to generate ions originating from compounds present in the micro area. Those ions are temporarily held within an ion trap and subsequently sent into a time-of-flight mass separator to separate the ions according to their mass-to-charge ratios and individually detect those ions. The imaging mass spectrometry unit 1 repeatedly performs such a series of operations, while gradually changing the position of the sample so that the laser irradiation point gradually moves on the sample, to ultimately collect mass spectrum data for all micro areas which are set within the ROI. The mass spectrum data collected at each micro area in the previously described manner, i.e., MS imaging data for the entire ROI, are stored in the data storage section 31 of the data processing unit 3.

After the imaging mass spectrometric analysis for one sample has been completed, the imaging mass spectrometric analysis for the other sample is similarly performed. The MS imaging data acquired for the entire ROI of the second sample are also stored in the data storage section 31 of the data processing unit 3.

At an appropriate point in time, an instruction for performing an analysis is given by a user, whereupon, for each subregion of interest of each sample, the individual test executer 33 reads MS imaging data from the data storage section 31, detects peaks in each set of mass spectrum data according to predetermined criteria, and determines the mass-to-charge-ratio value and signal-intensity value of each peak. Then, the individual test executer 33 collects the mass-to-charge-ratio values and signal-intensity values of the peaks detected in all mass spectrum data acquired for the micro areas included in the subregion of interest, and creates a data matrix (Step S14).

In FIGS. 4A and 4B, the two samples are labelled "A" and "B". The subregions of interest to which numbers (1) through (4) have been assigned in FIGS. 3A and 3B are denoted by "ROI-#1" through "ROI-#4", respectively. A data matrix at one subregion of interest is a matrix in which the signal-intensity values each of which has been acquired at one micro area for one mass-to-charge ratio value are arranged as the elements of the matrix, with the serial numbers of all micro areas in the subregion of interest vertically arrayed and the mass-to-charge-ratio values (M1, M2, M3, . . . ) of all peaks horizontally arrayed. If the sample is of biological origin, it is normally the case that an extremely large number of compounds are contained in the sample, and numerous peaks appear on one mass spectrum. Accordingly, the number of mass-to-charge-ratio values in the data, matrix (i.e., the number of columns of the matrix shown in FIG. 4A) is extremely large.

Next, for each pair of the subregions of interest to which the same serial number is assigned on the two samples, the individual test executer 33 compares mass spectrum peaks included in their data matrices. Specifically, a plurality of signal-intensity levels are defined by dividing the signal intensity of the peaks into predetermined intervals. In one data matrix created in the previously described manner for a large number of micro areas present within one subregion of interest, the number of micro areas whose signal-intensity values fall within one signal-intensity level is counted for each of the m/z values as well as for each of the signal-intensity levels. A histogram is created with the horizontal axis representing the signal-intensity levels and the vertical axis representing the number of micro areas whose signal-intensity values fall within each signal-intensity level. The number of histograms thus created is the same as that of the m/z values, i.e., the number of columns of the data matrix (Step S15). The same number of histograms as the m/z values can be created for each subregion of interest of each sample. In order to avoid counting noise peaks in the process of creating histograms, a micro area whose signal-intensity value does not exceed a predetermined value may be treated as a micro area having a signal-intensity value of zero (i.e., with no peak).

The individual test executer 33 subsequently performs a predetermined type of test on the large number of histograms (whose number equals that of the m/z values) created for the subregions of interest having the same serial number on the samples. Specifically, for example, the Mann-Whitney U test or Student's t-test can be performed to test the hypothesis that there is no difference between the two samples. By such a hypothesis test, the p-value, which indicates the probability with which the hypothesis can be considered to be correct, is calculated for each m/z value (Step S16). A small p-value means that there is a significant difference between the two samples in terms of the distribution of the m/z value concerned.

The p-value calculated by the individual test executer 33 is the result of a test of two subregions of interest having the same serial number assigned on the two samples. The general test index value calculator 34 integrates the test results (p-values) of all subregions of interest included in the ROIs, and calculates an index value showing the degree of difference in distribution for each m/z value (Step S17). For example, the product of all p-values obtained at all subregions of interest may be calculated as the index value.

An ROI includes various sites. A compound which shows a certain difference in content in one specific site may not show any significant difference in many other sites. In such a case, if a test for the entire ROI were performed, the influence of the difference in the content of the compound present in that specific site might be barely discernable in the test result. By contrast, in the previously described analytical method, if it is possible to appropriately set a comparatively small subregion of interest that includes the site where there is a difference in the content of the compound concerned, the influence of the difference in the content of that compound will be clearly reflected in the result of the test of that subregion of interest. The result of that test will also be reflected in the result of the test for the entire ROI. This increases the probability of the successful detection of an m/z value corresponding the compound that shows the difference in content between the two samples.

Based on the general index value calculated for each m/z value by the general test index value calculator 34, the m/z value sorter 35 sorts the m/z values in ascending order of general intensity value, i.e., in descending order of the probability of the presence of a difference in distribution. The display processor 36 displays the sorted result on the display unit 5 (Step S18). From this result, the user can preferentially select an m/z value at which a change in distribution is likely to be present between the two samples, and examine the corresponding MS imaging graphics.

The display processor 36 may additionally be configured to create MS imaging graphics in order of the sorted m/z values based on the collected imaging data, and display those graphics on the display unit 5. This configuration allows the user to preferentially examine MS imaging graphics corresponding to m/z values at which a change in distribution is likely to be present between the two samples.

Figure 5:
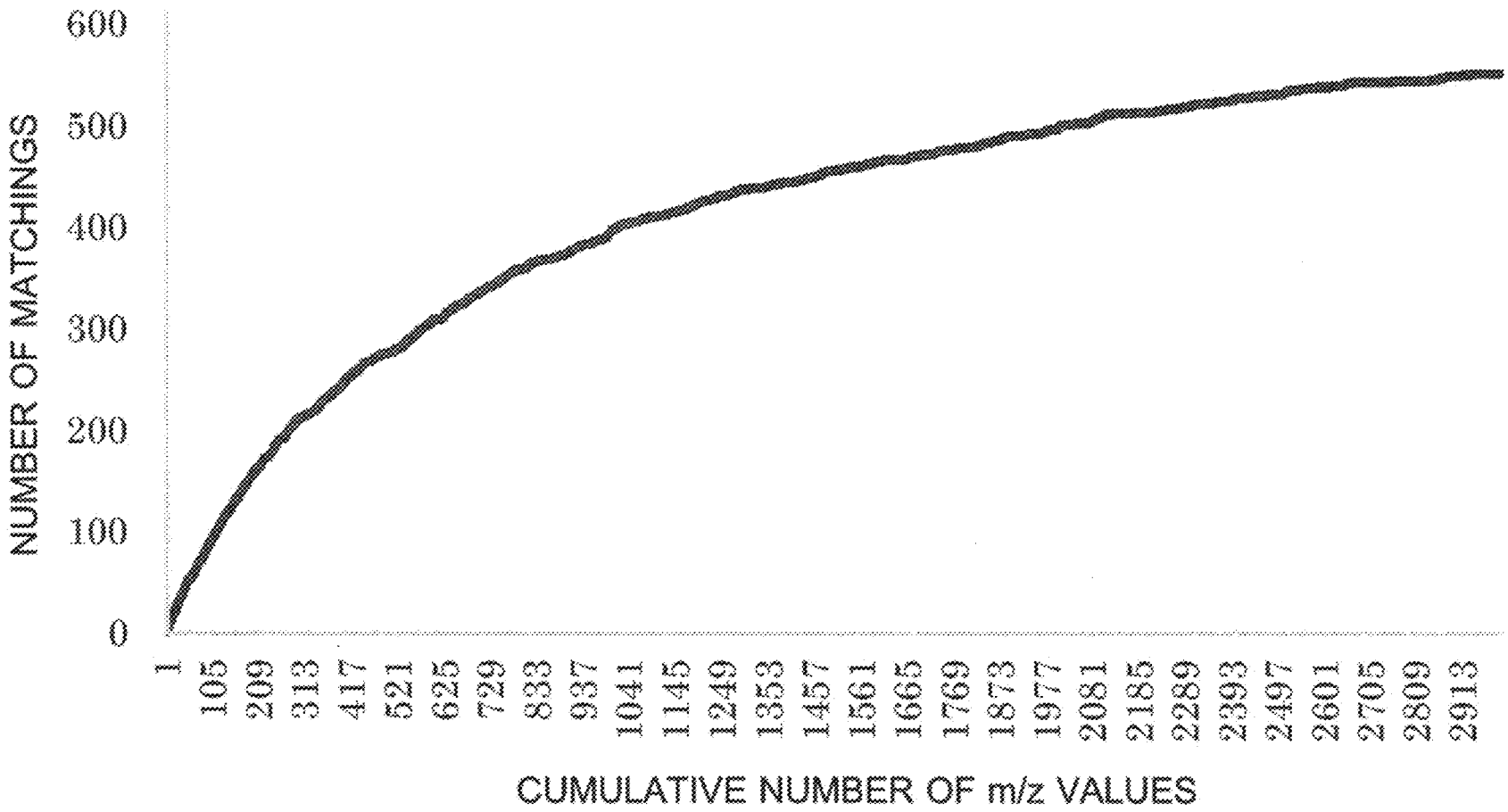
FIG. 5 is a graph showing a relationship between the cumulative number of m/z values after the sorting of the ink values and the number of m/z, values which agreed with the result of a visual examination in the imaging mass spectrometer according to the present embodiment.

FIG. 5 shows the result of an experiment based on MS imaging data actually collected at 3000 m/z values for two samples. MS imaging graphics of the two samples were created for each of those m/z values and manually examined by sight. Consequently, 550 m/z values at which there was a difference in distribution between the samples were selected. Meanwhile, the previously described analytical method was applied to the same set of MS imaging data to obtain a sorted list of the 3000 m/z values. The graph in FIG. 5 shows the degree of matching between the two sets of m/z values thus prepared. The horizontal axis indicates the cumulative number of m/z values. Located at the leftmost position on this axis is the value with the highest probability of the presence of a difference. As the position moves rightwards, the m/z values are sequentially counted in descending order of probability. The vertical axis indicates the number of selected m/z values included in the already counted m/z values.

The curve shown the graph of FIG. 5 steeply rises at the beginning of its rightward extension from the leftmost end. This means that the m/z values preferentially selected by the previously described analytical method as m/z values at which a difference in distribution is present include a considerable number of m/z values which have also been selected by the visual examination. In the present example, nearly one half of the m/z values which have been selected by the visual examination, or specifically, 250 m/z values, are included in the first 300 m/z values selected by the previously described analytical method as m/z values at which a difference in distribution is present. This result can be interpreted as follows: The searching efficiency would have been 550/3000 if the previously described analytical method was not used to search for the m/z values at which a difference in distribution as present. The use of the analytical method improved the searching efficiency to 250/300. In other words, using the previously described analytical method improved the searching efficiency by a factor of roughly five.

In the imaging mass spectrometer according to the previously described embodiment, a hypothesis test is used to locate m/z values at which a difference in distribution is present between the two subregions of interest corresponding to each other on two samples, and to quantify the probability of the presence of the difference. The available techniques are not limited to hypothesis tests. For example, a different means which employs the confidence interval, effect size or other quantities in Bayesian estimation may be used for the evaluation.

In the previously described analytical procedure, the setting of the ROI and subregions of interest is performed on an optical microscopic image of a sample in advance of an imaging mass spectrometric analysis. It is also possible to perform the imaging mass spectrometric analysis for the entire sample earlier, followed by the setting of the ROI and subregions of interest as well as an analysis using only the data included in the set regions. Thus, the processes of Steps S10 through S13 in FIG. 2 may be appropriately transposed and do not always need to be carded out in the previously described order.

It should be noted that the previously described embodiment is a mere example of the present invention, and any change, modification, addition or the like appropriately made within the spirit of the present invention will naturally fall within the scope of claims of the present application.

Various Modes of Invention

A person skilled in the art can understand that the previously described illustrative embodiment is a specific example of the following modes of the present invention.

(Clause 1) One mode of the method for imaging mass spectrometry according to the present invention is a method for imaging mass spectrometry in which a plurality of samples of the same kind are analyzed using mass spectrometric data acquired by performing an imaging mass spectrometric analysis on each of a plurality of micro areas which are set on each of the plurality of samples, the method including:

a region-of-interest setting step configured to set a region of interest on each of the plurality of samples to be analyzed, and to divide each of the regions of interest into the same number of subregions each including a plurality of micro areas so that the subregions correspond to each other on the plurality of samples respectively covering roughly identical sites on the samples;

an individual-index-value calculation step configured to calculate an individual index value for each of the subregions, using mass spectrometric data acquired at micro areas included in the subregion, the individual index value reflecting the similarity or difference among the plurality of samples in terms of a degree of expression of each mass-to-charge-ratio value; and a general-index-value calculation step configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

(Clause 5) One mode of the imaging mass spectrometer according to the present invention is an imaging mass spectrometer in which a plurality of samples of the same kind are analyzed using results acquired by performing an imaging mass spectrometric analysis on each of the plurality of samples, the imaging mass spectrometer including:

a measurement section configured to acquire mass spectrometric data by performing an imaging mass spectrometric analysis on each of a plurality of micro areas which are set on a sample;

a region-of-interest setter configured to set a region of interest on each of the plurality of samples to be analyzed, and to divide each of the regions of interest into the same number of subregions each including a plurality of micro areas so that the subregions correspond to each other on the plurality of samples respectively covering roughly identical sites on the samples;

an individual-index-value calculator configured to calculate an individual index value for each of the subregions, using mass spectrometric data acquired by the measurement section at the micro areas included in the subregion, the individual index value reflecting the similarity or difference among the plurality of samples in terms of a degree of expression of each mass-to-charge-ratio value; and a general-index-value calculator configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

In the previously described modes of the method for mass spectrometry described in Clause 1 and the imaging mass spectrometer described in Clause 5, each region of interest is divided into a plurality of subregions having a relatively small area, and the individual index value is calculated for each subregion rather than the entire region of interest. Therefore, information concerning a compound which exhibits a difference in distribution within a small region on the samples can be accurately obtained. This enables efficient and accurate detection of a compound exhibiting a difference in distribution or intensity among a plurality of samples.

(Clause 2) The method for imaging mass spectrometry described in Clause 1 may further include a display processing step configured to determine the order of priority of the mass-to-charge-ratio values based on the general index value, and to display information of the mass-to-charge-ratio values or mass spectrometric imaging graphics at those mass-to-charge-ratio values in a sorted form according to the order of priority.

(Clause 6) The imaging mass spectrometer described in Clause 5 may further include a display processor configured to determine the order of priority of the mass-to-charge-ratio values based on the general index value, and to display information of the mass-to-charge-ratio values or mass spectrometric imaging graphics at those mass-to-charge-ratio values in a sorted form according to the order of priority.

The method for imaging mass spectrometry described in Clause 2 and the imaging mass spectrometer described in Clause 6 allow users to examine mass spectrometric imaging graphics at m/z, values in descending order of the probability of the presence of a difference in distribution among a plurality of samples. Accordingly, the user can efficiently perform the differential analysis of the plurality of samples.

(Clause 3) In the method for imaging mass spectrometry described in Clause 1 or 2, the region-of-interest setting step may be configured to allow a user to set the region of interest on a screen on which an observation image of the surface of the sample to be analyzed is displayed, and to divide the region of interest into the subregions.

(Clause 7) In the imaging mass spectrometer described in Clause 5 or 6, the region-of-interest setter may be configured to allow a user to set the region of interest on a screen on which an observation image of the surface of the sample to be analyzed is displayed, and to divide the region of interest into the subregions.

The method for imaging mass spectrometry described in Clause 3 and the imaging mass spectrometer described in Clause 7 allow users to apply their knowledge and judgments in setting a suitable region of interest for differential analysis, and to appropriately divide the region of interest so that the m/z values at which a difference in distribution is present can be correctly located.

(Clause 4) In the method for imaging mass spectrometry described in one of Clauses 1-3, the individual-index-value calculation step may be configured to calculate the individual index value for each of the subregions, using mass spectrometric data acquired at micro areas included in the subregion, by creating, for each mass-to-charge-ratio value, a histogram showing a relationship between a signal-intensity level and the number of micro areas, and performing a test on the histograms respectively acquired at the mass-to-charge-ratio values for the plurality of samples.

(Clause 8) In the imaging mass spectrometer described in one of Clauses 5-7, the individual-index-value calculator may be configured to calculate the individual index value for each of the subregions, using mass spectrometric data acquired at micro areas included in the subregion, by creating, for each mass-to-charge-ratio value, a histogram showing a relationship between a signal-intensity level and the number of micro areas, and performing a test on the histograms respectively acquired at the mass-to-charge-ratio values for the plurality of samples.

For example, the "test" in the present context may be a hypothesis test for testing the hypothesis that a difference in distribution is present or not present. By the method for imaging mass spectrometry described in Clause 4 and the imaging mass spectrometer described in Clause 8, the information of the m/z values at which a difference in distribution is present among a plurality of samples can be extracted with a high degree of certainty by a comparatively simple process.

REFERENCE SIGNS LIST

1 . . . Imaging Mass Spectrometry Unit
2 . . . Optical Microscopic Observation Unit
3 . . . Data Processing Unit
31 . . . Data Storage Section
32 . . . ROI/Subregion Setting Processor
33 . . . Individual Test Executer
34 . . . General Test Index Value Calculator
35 . . . m/z Value Sorter
36 . . . Display Processor
4 . . . Input Unit
5 . . . Display Unit

The invention claimed is:

1. A method for imaging mass spectrometry in which a plurality of samples of a same kind are analyzed using mass spectrometric data acquired by performing an imaging mass spectrometric analysis on each of a plurality of micro areas which are set on each of the plurality of samples, the method comprising:

a region-of-interest setting step configured to set a region of interest on each of the plurality of samples to be analyzed, and to divide each of the regions of interest into a same number of subregions each including a plurality of micro areas so that the subregions correspond to each other on the plurality of samples respectively covering roughly identical sites on the samples;

an individual-index-value calculation step configured to calculate an individual index value for each of the subregions, using mass spectrometric data acquired at micro areas included in the subregion, the individual index value reflecting a similarity or difference among the plurality of samples in terms of a degree of expression of each mass-to-charge-ratio value; and a general-index-value calculation step configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

2. The method for imaging mass spectrometry according to claim 1, further comprising a display processing step configured to determine an order of priority of the mass-to-charge-ratio values based on the general index value, and to display information of the mass-to-charge-ratio values or mass spectrometric imaging graphics at those mass-to-charge-ratio values in a sorted form according to the order of priority.

3. The method for imaging mass spectrometry according to claim 1, wherein the region-of-interest setting step is configured to allow a user to set the region of interest on a screen on which an observation image of a surface of the sample to be analyzed is displayed, and to divide the region of interest into the subregions.

4. The method for imaging mass spectrometry according to claim 1, wherein the individual-index-value calculation step is configured to calculate the individual index value for each of the subregions, using mass spectrometric data acquired at micro areas included in the subregion, by creating, for each mass-to-charge-ratio value, a histogram showing a relationship between a signal-intensity level and a number of micro areas, and performing a test on the histograms respectively acquired at the mass-to-charge-ratio values for the plurality of samples.

5. An imaging mass spectrometer in which a plurality of samples of a same kind are analyzed using results acquired by performing an imaging mass spectrometric analysis on each of the plurality of samples, the imaging mass spectrometer comprising:

a measurement section configured to acquire mass spectrometric data by performing an imaging mass spectrometric analysis on each of a plurality of micro areas which are set on a sample;

a region-of-interest setter configured to set a region of interest on each of the plurality of samples to be analyzed, and to divide each of the regions of interest into a same number of subregions each including a plurality of micro areas so that the subregions correspond to each other on the plurality of samples respectively covering roughly identical sites on the samples;

an individual-index-value calculator configured to calculate an individual index value for each of the subregions, using mass spectrometric data acquired by the measurement section at the micro areas included in the subregion, the individual index value reflecting a similarity or difference among the plurality of samples in terms of a degree of expression of each mass-to-charge-ratio value; and a general-index-value calculator configured to calculate a general index value for each mass-to-charge-ratio value among the regions of interest of the plurality of samples, using the individual index values calculated for the mass-to-charge-ratio values for each of the plurality of subregions included in each of the regions of interest of the plurality of samples.

6. The imaging mass spectrometer according to claim 5, further comprising a display processor configured to determine an order of priority of the mass-to-charge-ratio values based on the general index value, and to display information of the mass-to-charge-ratio values or mass spectrometric imaging graphics at those mass-to-charge-ratio values in a sorted form according to the order of priority.

7. The imaging mass spectrometer according to claim 5, wherein the region-of-interest setter is configured to allow a user to set the region of interest on a screen on which an observation image of a surface of the sample to be analyzed is displayed, and to divide the region of interest into the subregions.

8. The imaging mass spectrometer according to claim 5, wherein the individual-index-value calculator is configured to calculate the individual index value for each of the subregions, using mass spectrometric data acquired at micro areas included in the subregion, by creating, for each mass-to-charge-ratio value, a histogram showing a relationship between a signal-intensity level and the number of micro areas, and performing a test on the histograms respectively acquired at the mass-to-charge-ratio values for the plurality of samples.

* * * * *